US006866344B2

(12) United States Patent
Oh

(10) Patent No.: US 6,866,344 B2
(45) Date of Patent: Mar. 15, 2005

(54) WHEEL FOR IN-LINE SKATES

(76) Inventor: Jun-Seok Oh, 208-2203 Jugong, Apt. 874 Dang-dong, Gumbo-si, Kyunggi-do (KP)

( * ) Notice: Subject to any disclaimer, the term of this patent is extended or adjusted under 35 U.S.C. 154(b) by 0 days.

(21) Appl. No.: 10/620,955

(22) Filed: Jul. 16, 2003

(65) Prior Publication Data

US 2004/0124692 A1 Jul. 1, 2004

(30) Foreign Application Priority Data

Dec. 27, 2002 (KR) ..... 10-2002-0084746

(51) Int. Cl.[7] ..... A63C 17/22
(52) U.S. Cl. ..... 301/5.301; 152/13; 280/11.22
(58) Field of Search ..... 301/5.301, 5.7, 301/5.306, 5.309, 5.305, 5.307, 5.308, 111.03; 152/1, 11, 13, 17, 323, 326, 327, 23, 246, 247, 248; 16/46; 280/11.209, 11.22, 11.19

(56) References Cited

U.S. PATENT DOCUMENTS 5,393,078 A * 2/1995 Bourdeau ..... 280/11.225
5,441,286 A 8/1995 Pozzobon
5,649,716 A * 7/1997 Zhang ..... 280/11.19
5,813,678 A 9/1998 Robins
5,823,293 A 10/1998 Gilbertson et al.
5,853,226 A * 12/1998 Lee ..... 301/5.309
5,893,569 A 4/1999 Robins
6,019,378 A 2/2000 Cushing
6,065,760 A 5/2000 Weygandt
6,142,578 A 11/2000 Pawloski et al.
6,286,907 B1 * 9/2001 Meader ..... 301/5.306

FOREIGN PATENT DOCUMENTS

JP 11235411 8/1999

* cited by examiner

*Primary Examiner*—Frantz F. Jules
(74) *Attorney, Agent, or Firm*—DLA Piper Rudnick Gray Cary US LLP

(57) ABSTRACT

A wheel for in-line skates, which enables a user to achieve a higher speed in a short period of time on a surface, is disclosed. The wheel includes a central hub having an inner ring, an outer rim, and a connector extending between the inner ring and the outer rim, a tire surrounding the outer rim, and a bearing assembly fitted in the inner ring. The central hub includes a reception cavity provided in the connector, a weight received in the reception cavity to be moved toward the outer rim portion by a centrifugal force of the wheel, and an elastic element for biasing the weight. The tire includes a central tread portion, and curved side portions disposed at both sides of the central tread portion. The curved side portions include soft portions having a coefficient of friction higher that that of the central tread portion.

4 Claims, 10 Drawing Sheets

WHEEL FOR IN-LINE SKATES

BACKGROUND OF THE INVENTION

1. Field of the Invention

The present invention relates to a wheel for in-line skates, and more particularly to a wheel for in-line skates which enables a user to improve an acceleration from standstill on a surface, in which the ability is estimated by a time period required to accelerate from a standstill to a certain speed or to travel from the standstill to a certain distance.

2. Description of the Prior Art

Referring to FIGS. 1 and 2, there is shown a conventional in-line skate 1. As shown in FIGS. 1 and 2, the in-line skate 1 is generally comprised of a shoe or boot 2 adapted to receive a user's foot, a frame 3 fixedly attached to a bottom surface of the boot 2, and a series of wheels 4 rotatably supported to the frame 3. Each of the wheels 4 comprises a central hub 5, an annular tire 6 provided on an outer surface of the central hub 5, and a bearing assembly 7 fitted in the central hub 5.

In games played while wearing such an in-line skate 1, such as racing, aggressive inline skating, hockey and the like, it is advantageous for a user to achieve a high speed in a short time period. That is, the acceleration from standstill is a very important factor in determining a user's (skater's) competitive power.

Since the in-line skate 1 and the wheels 4 are not provided with means for improving a user's acceleration from a standstill, the acceleration which can be achieved on a surface, will depend on only a user's muscle power. The user's power has a certain limit and is gradually decreased with time, because the user's power is not obtained by a mechanical device. Accordingly, although a user makes efforts to enhance his muscle power and to improve his skating skill over a long term, improvement of his accelerating ability from a standstill is negligible. As a result, it is expected that a user's acceleration from a standstill can be improved by wheels with an improved structure.

Recently, with the increase in popularity of in-line skates, a large number of patents relating to in-line skates, particularly to wheels of the in-line skate, have been proposed. Most of the patents relate to bearing assemblies 7 of the in-line skate, and some patents relate to the tire 6 of the in-line skate. For example, U.S. Pat. Nos. 5,441,286, 5,964,469, 6,065,760 and 6,142,578, and Japanese Patent Laid-open No. 11-235411 propose structures of the bearing assemblies considering economical efficiency. U.S. Pat. Nos. 5,813,678, 5,893,569, 6,019,378 and the like propose structures of tires for achieving quick stop, referred to as a "hockey-stop". However, the wheels proposed in the above-mentioned patents are not provided with means for improving a user's acceleration from a standstill, like the wheel 4 illustrated in FIG. 2.

SUMMARY OF THE INVENTION

Accordingly, the present invention has been made keeping in mind the above problems occurring in the prior art, and an object of the present invention is to provide a wheel for in-line skates which is provided with means for enabling a user to improve his acceleration from a standstill on a surface, and which can be constructed on the basis of a typical wheel of an in-line skate.

In order to accomplish the above object, the present invention provides a wheel for in-line skates comprising, a central hub including an inner ring portion, an outer rim portion disposed around the inner ring portion, and a connector extending between the inner ring portion and the outer rim portion, a tire surrounding the outer rim portion of the central hub, and a bearing assembly fitted in the inner ring portion of the central hub.

According to an aspect of the present invention, the central hub includes a reception cavity provided in the connector, a weight received in the reception cavity and adapted to be moved from the inner ring portion to the outer rim portion of the central hub by a centrifugal force of the wheel, and an elastic element for biasing the weight to the inner ring portion.

According to another aspect of the present invention, the tire includes a central tread portion, and curved side portions disposed at both sides of the central tread portion. At least one of both the curved side portions is provided with a soft portion having a higher coefficient of friction, compared to the central tread portion.

According to still another aspect of the present invention, the wheel has both the above-mentioned two aspects.

BRIEF DESCRIPTION OF THE DRAWINGS

The above and other objects, features and advantages of the present invention will be more clearly understood from the following detailed description taken in conjunction with the accompanying drawings, in which:

FIG. 9 is a view similar to FIG. 7, which shows another embodiment of soft portions; and.

DETAILED DESCRIPTION OF THE INVENTION

This invention will be described in further detail by way of example with reference to the accompanying drawings.

Figure 1:
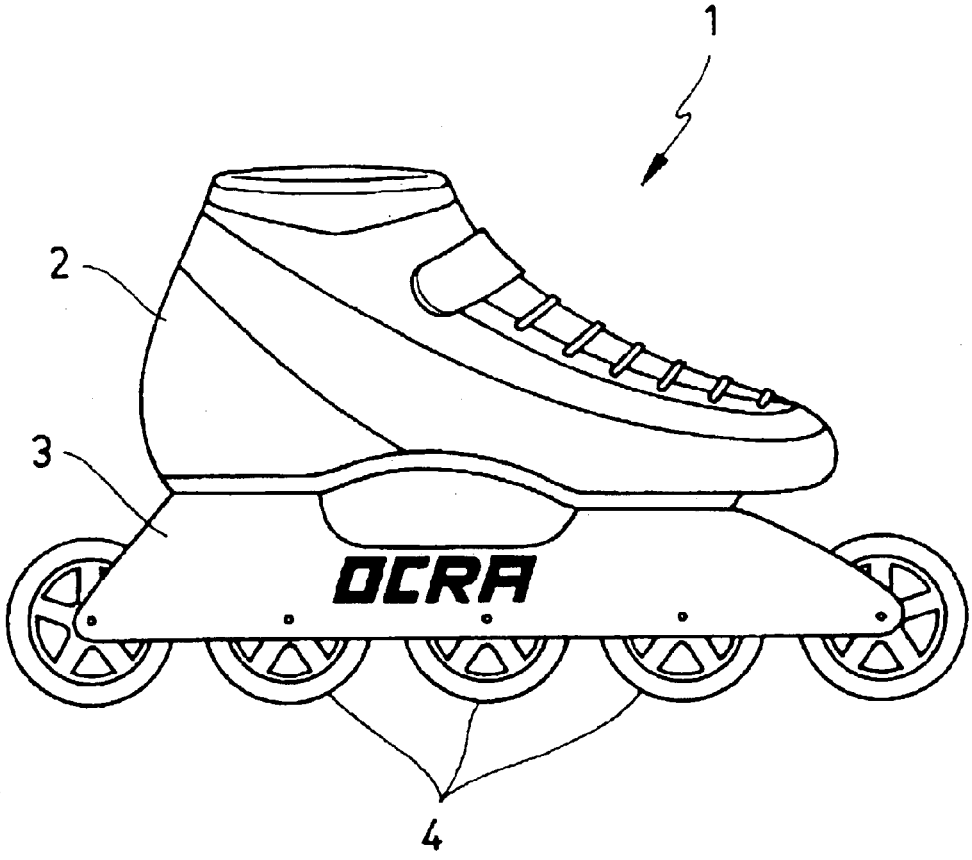
FIG. 1 is a side view showing a conventional in-line skate.
Figure 2:
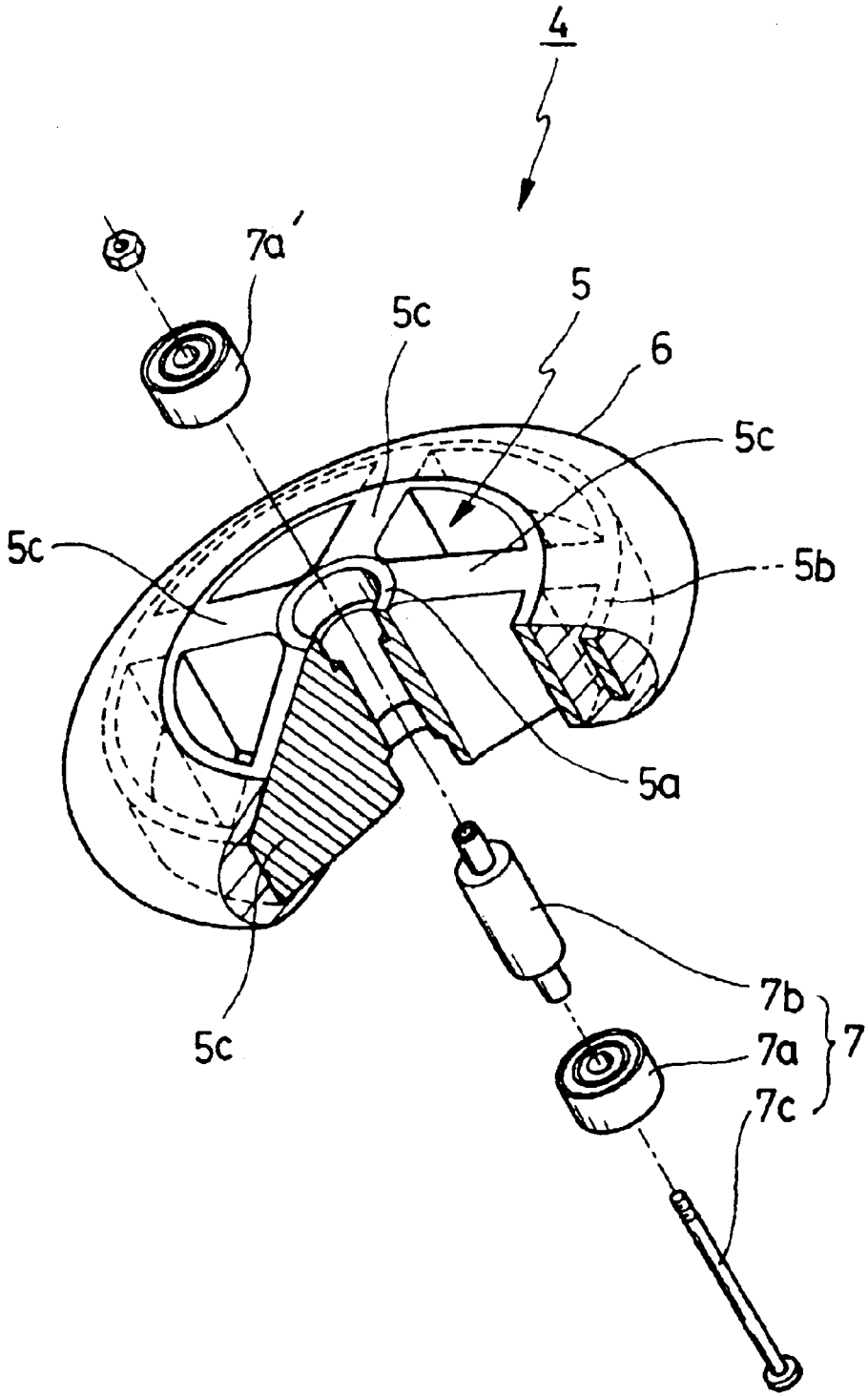
FIG. 2 is a perspective view showing a wheel of the in-line skate shown in FIG. 1, which is partly cut away.
Figure 3:
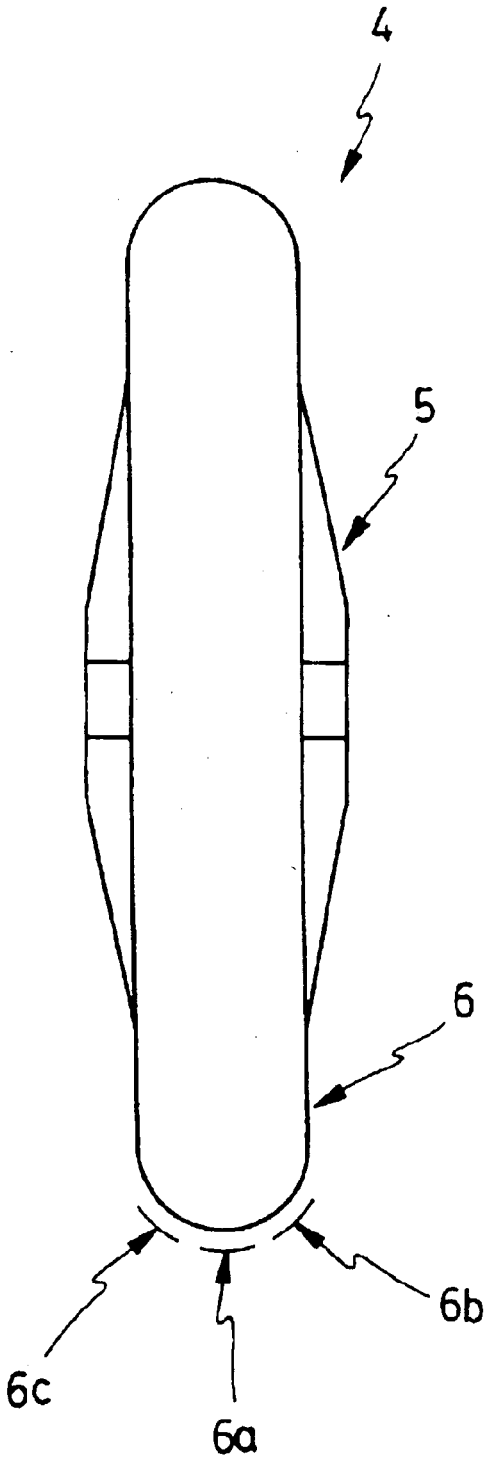
FIG. 3 is a side view of the wheel shown in FIG. 2.

First, a structure of a typical wheel of an in-line skate is described. As shown in FIGS. 2 and 3, a typical wheel 1 for in-line skates includes a central hub 5 comprised of an inner ring portion 5*a*, an outer rim portion 5*b* concentrically disposed around the inner ring portion 5*a*, and spokes 5*c* radially extending and connected between the inner ring portion 5*a* and the outer rim portion 5*b*, and an annular tire 6 surrounding the outer rim portion 5*b* of the central hub 5 and having a central tread portion 6*a* and curved side portions 6*b* and 6*c* disposed at both sides of the central tread portion 6*a*.

The wheel 1 further includes a bearing assembly 7 fitted in the inner ring portion 5*a*. Although the bearing assemblies 7 having various structures are known, the most typical bearing assembly comprises left and right bearings 7*a* and 7*a*', a spacer interposed between the left and right bearings 7*a* and 7*a*', and an axle 7*c* penetrating the bearings 7*a* and 7*a*' and the spacer 7*b*. In this specification, since the present invention does not pertain to the bearing assembly 7, a detailed description thereof is omitted.

The central hub 5 is usually produced from plastic or metal material (aluminum) by a molding process, and the tire 6 is usually produced from elastic resin, specifically polyurethane, and is integrally molded with the central hub 5.

The following embodiments are produced on the basis of a typical wheel 1 for in-line skates. Therefore, the same reference numerals are used throughout the different drawings to designate the same components as those of the wheel 1 for an in-line shown in FIGS. 2 and 3.

Embodiment 1

Figure 4:
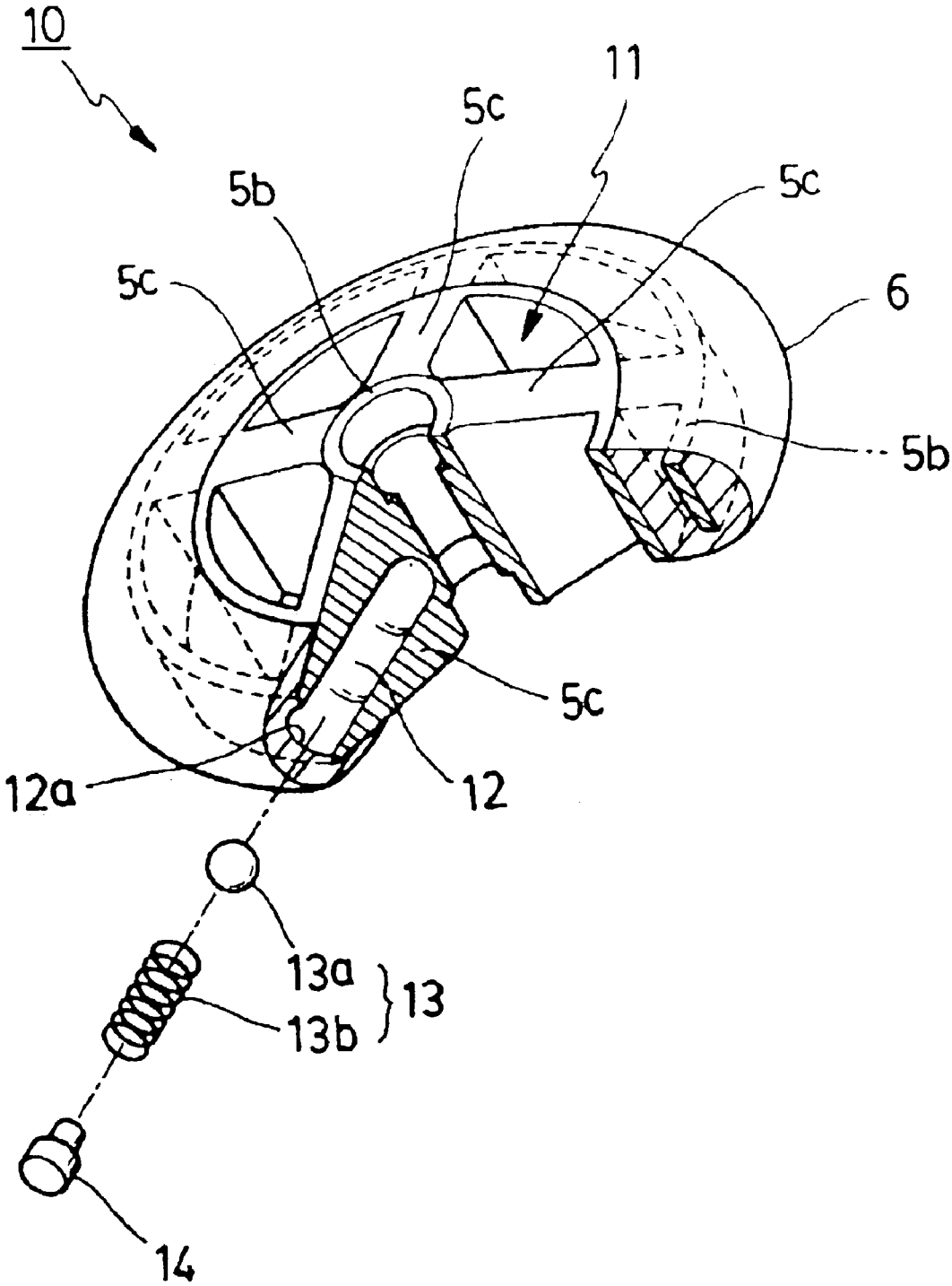
FIG. 4 is a perspective view showing a wheel for an in-line skate according to a first embodiment of the present invention, which is partly cut away.

FIG. 4 shows a wheel 10 for in-line skates according to a first embodiment of the present invention, in which a central hub 5 is provided with means for increasing a turning force of the wheel. According to this embodiment, the central hub 11 of the wheel 10 includes reception cavities 12 radially provided in respective spokes 5*c*, and acceleration sets 13 received in the reception cavities 12 to increase a turning force of the wheel 10.

More specifically, each of the reception cavities 12 is formed such that an outer end of the reception cavity 12 is positioned at an outer surface of the outer rim portion 5*b* of the central hub 11 and opened thereat, and an inner end thereof is positioned near to the inner ring portion 5*a*. The opening 12*a* formed at the outer end of the reception cavity 12 is closed by a locking plug 14. Although not illustrated in the drawings, the reception cavity 12 may be formed from the inner surface of the inner ring portion 5*a* to a position near to the outer surface of the outer rim portion 5*b*. Alternatively, the reception cavity 12 may be formed to have blind opposite ends without the locking plug 14.

Each of the acceleration set 13 comprises a weight 13*a* and an elastic element 13*b*. Preferably, the weight 12*a* is a metal ball, and the elastic element 13*b* is an elastic spring.

Figure 5:
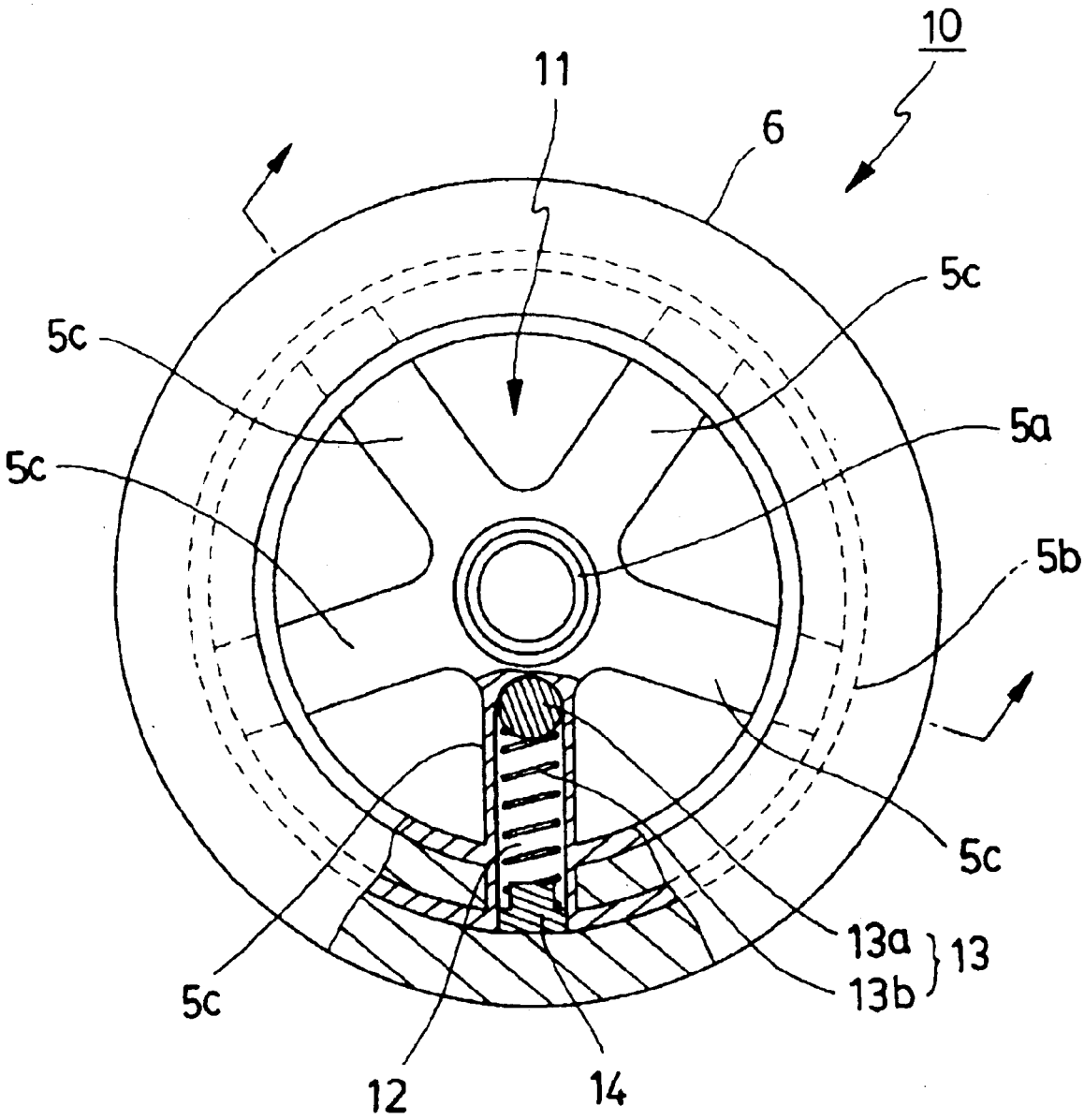
FIG. 5 is a front view of the wheel shown in FIG. 4, which is stopped.
Figure 6:
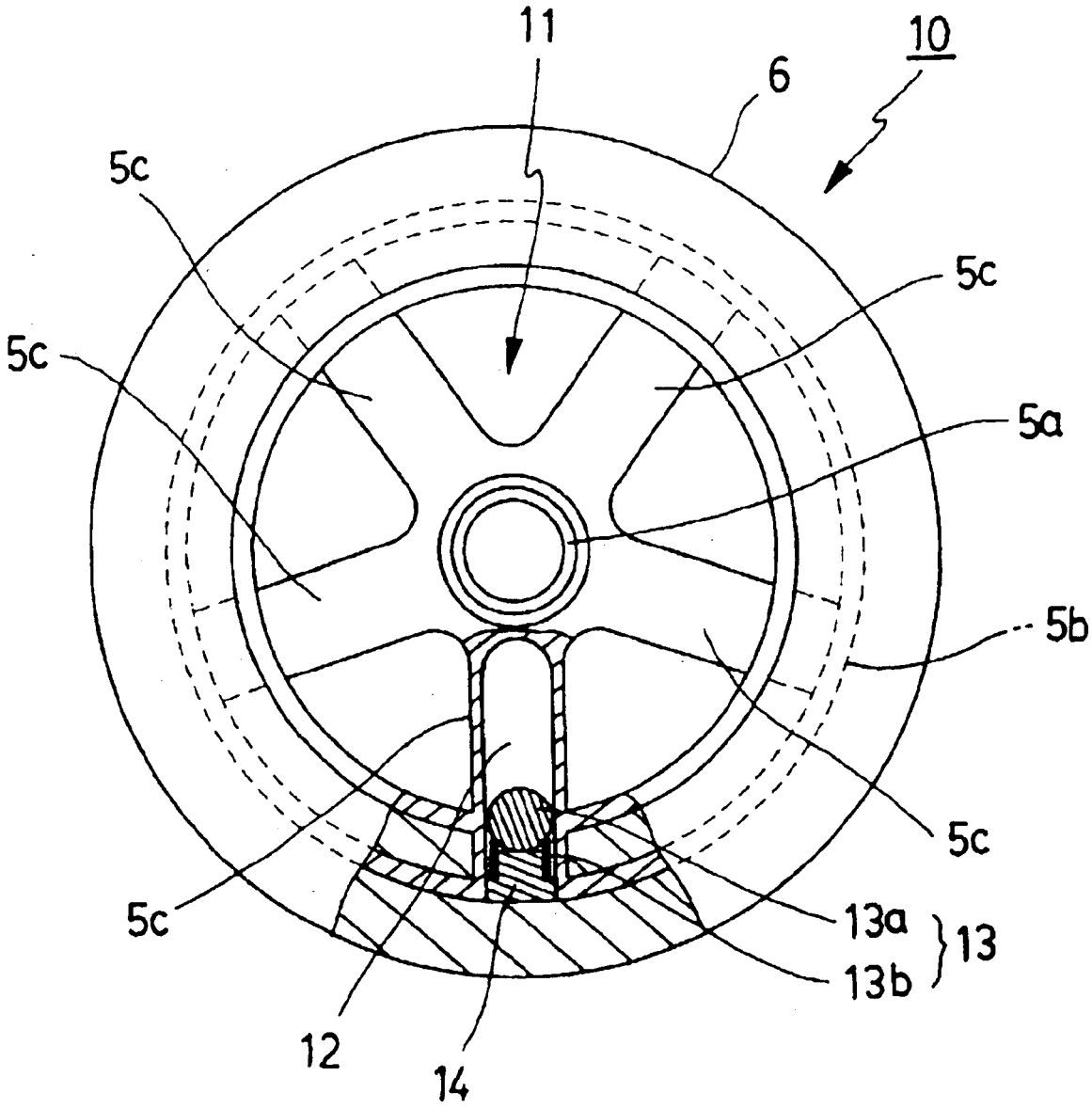
FIG. 6 is a view similar to FIG. 5, in which the wheel is rotated.

In this embodiment, when a rotation of the wheel 10 is stopped, the weight 13*a* is positioned near to the inner ring portion 5*a* by elasticity of the spring 13*b* (see FIG. 5). As the wheel 10 is rotated from the stopped position, the weight 13*a* is moved toward the outer rim portion 5*b* by a centrifugal force of the wheel 10 (see FIG. 6). When all the weights 13*a* are positioned near to the outer rim portion 5*b*, the wheel 10 has a moment of inertia increased in proportion to the total weight added to the outer rim portion 5*b*.

In other words, when the wheel 10 is rotated at a certain speed, the turning force of the wheel 10 is increased by the acceleration sets 13. Consequently, an in-line skate with the wheel 10 mounted thereon enables a user to achieve a higher speed in a short period of time by the increased turning force.

Embodiment 2

Figure 7:
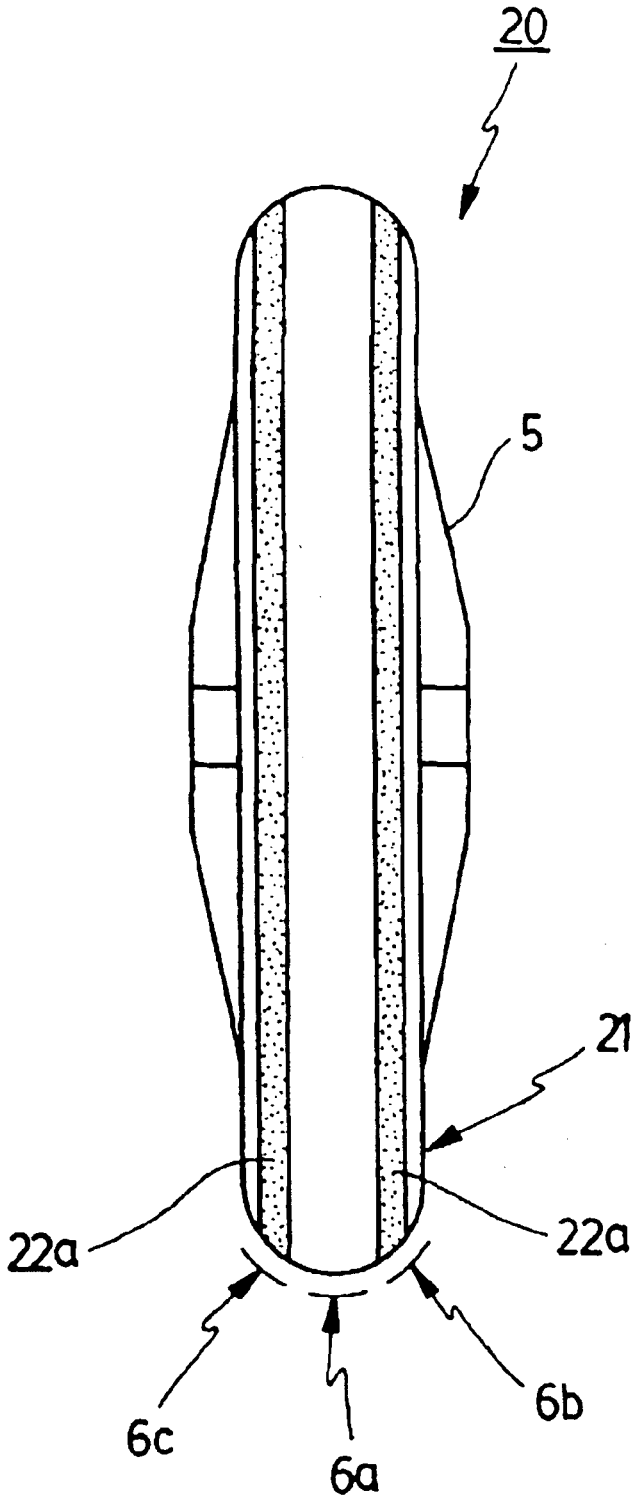
FIG. 7 is a side view showing a wheel for an in-line skate according to a second embodiment of the present invention.

FIG. 7 shows a wheel 20 for an in-line skate according to a second embodiment of the present invention, in which the tire as shown in FIG. 2 is provided with means for minimizing loss of a user's muscle power. According to this embodiment, the tire 21 of the wheel 20 is provided at the curved side portions 6*b* and 6*c* thereof with annular soft portions 22*a* having a coefficient of friction with respect to a skating surface which is higher than that of the central tread portion 6*a*.

Among known skating techniques, a "push" action for accelerating employs a frictional force generated between an inside curved portion of a tire and a skating surface. This frictional force originates from only a push power based on a user's body weight and physical strength.

In general, a polyurethane hardness (durometer) of a wheel tire of an athletic in-line skate is about Shore 80A–95A, which is a relatively high value, compared to a wheel tire of an amateur in-line skate having a polyurethane hardness of about Shore 60A–80A. The reason why the wheel tire having a relatively higher shore hardness is as follows. That is, since a tolling resistance with respect to a skating surface is decreased as a shore hardness of the wheel tire is increased, the hard wheel enables a user to skate at a higher speed. Meanwhile, the higher the hardness of the wheel tire is, the greater the chance of sideways slipping or skidding on a skating surface when a "push" action is carried out. In this case, the push power does not contribute to increasing the effective frictional force, resulting in loss of push power.

In this embodiment, since the soft portions 22*a* prevent an undesirable sideslip or skid prone to occur during a push action, the soft portions 22*a* serve to minimize loss of a push power. Accordingly, by use of an in-line skate having the wheel 20 of the present invention, a user can achieve a higher speed in a short period of time by his/her muscle power without loss of power.

Figure 8:
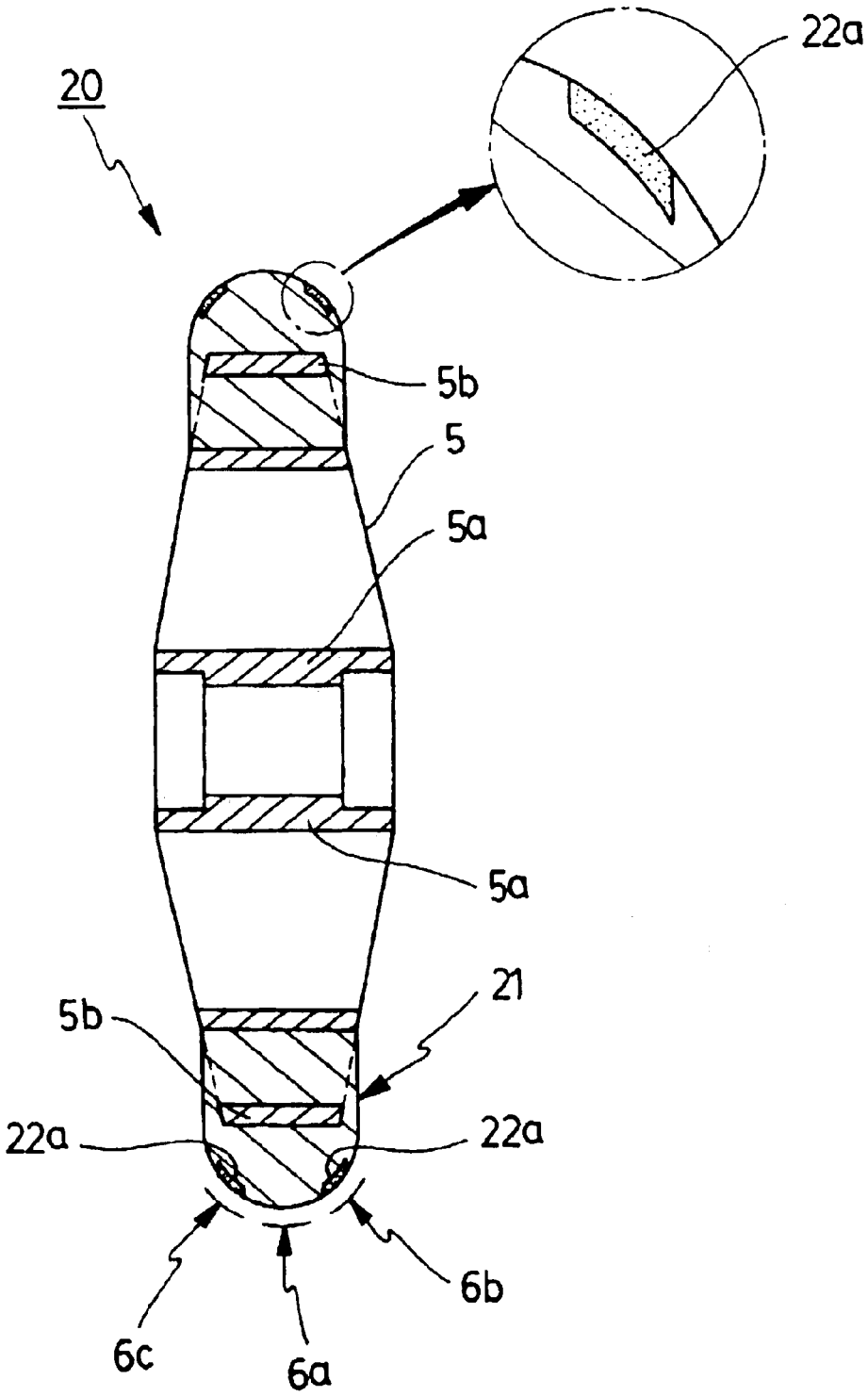
FIG. 8 is a cross-sectional view of the wheel shown in FIG. 7, which shows a variant of soft portions.
Figure 9:
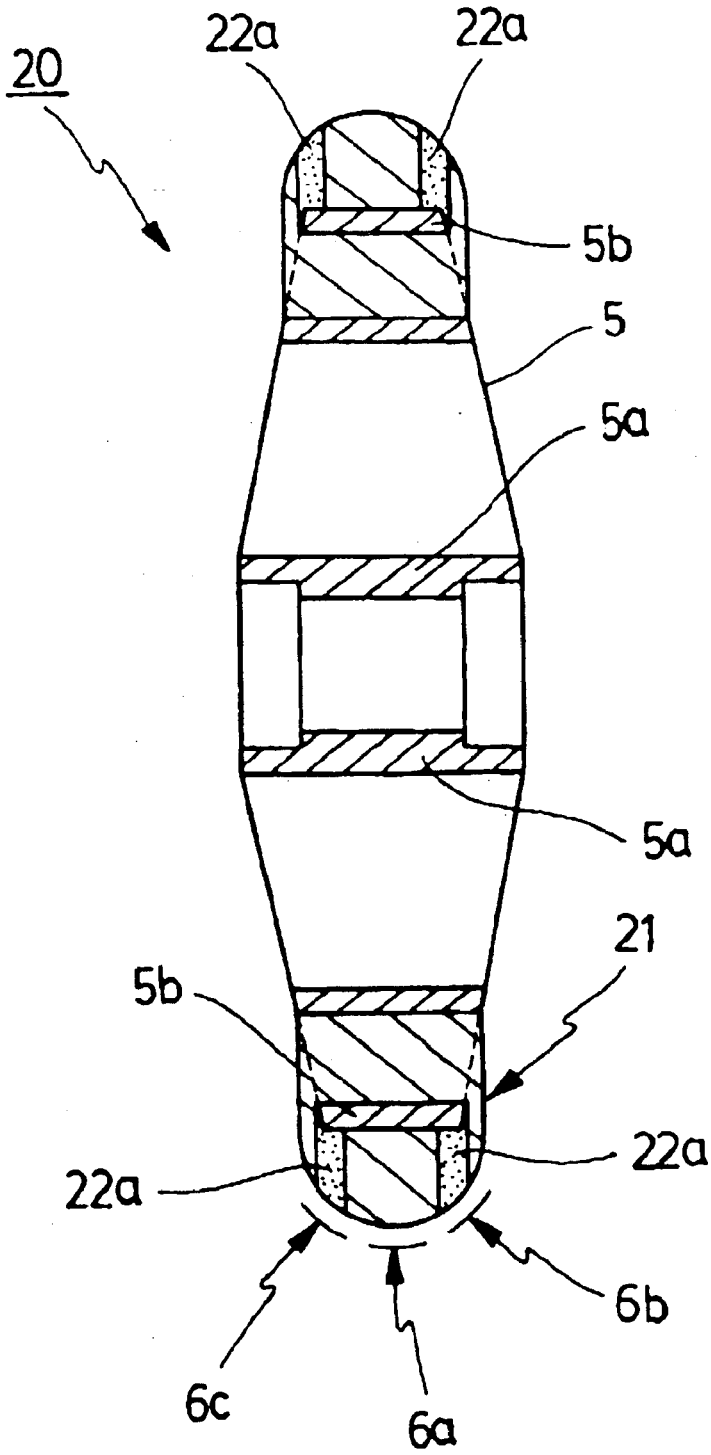

The soft portions 22*a* of the tire 21 are made of polyurethane or synthetic rubber, which has a lower hardness (about Shore 40A–60A), compared to the tread portion 6*a* of the tire 21. The soft portions 22*a* may be embodied as rings surrounding the curved side portions 6*b* and 6*c* (see FIG. 8), or layers interposed between hard layers of the tire body (see FIG. 9).

The soft portion 22*a* may be provided only at the inner curved portion 6*b* of the tire 21, and may be comprised of a series of thin soft portions, so as to minimize loss of a user's push power. In general, since the wheel tire 21 is severely worn at the inner curved portion thereof, compared to the outer curved portion thereof, a user may reuse the worn wheel tire by switching the worn inner curved portion of the wheel tire to the outside. Therefore, it is preferable that both curved side portions 6*b* and 6*c* of the wheel tire 21 are provided with the soft portions 22*a*.

Embodiment 3

Figure 10:
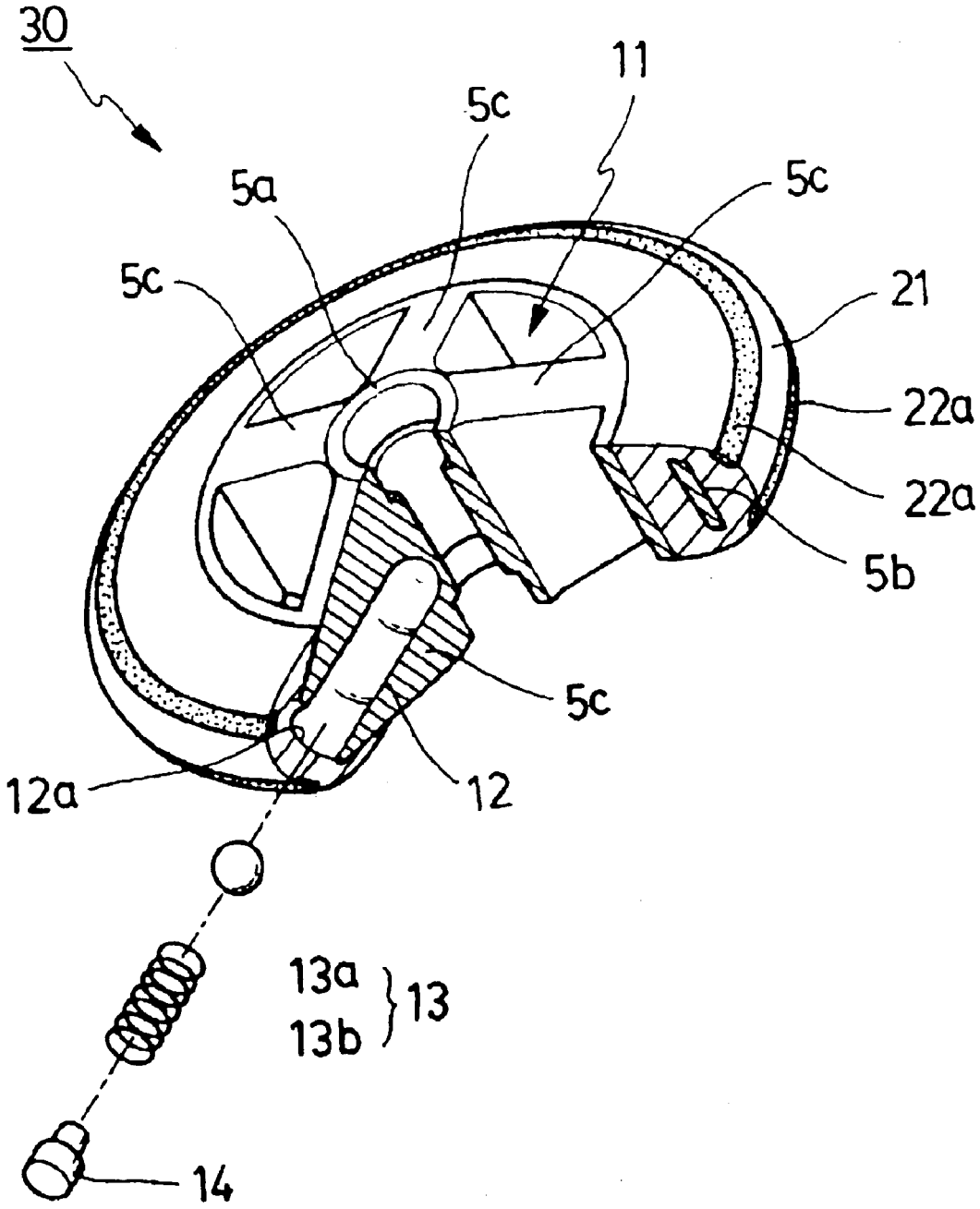
FIG. 10 is a perspective view showing a wheel for an in-line skate according to a third embodiment of the present invention, which is partly cut away.

FIG. 10 shows a wheel 30 for an in-line skate according to a third embodiment of the present invention, which is applied with both the hub 11 of the first embodiment and the tire 21 of the second embodiment. According to this embodiment, the wheel 30 for an in-line skate comprises the hub 11 having the acceleration set 13 therein, and the tire 21 having the soft portions at curved side portions thereof. The wheel 30 has a higher effect by utilizing both advantages of the first and second embodiments.

In this embodiment, when a rotation of the wheel 30 is stopped, the weight 13*a* is positioned near to the inner ring portion 5*a* by elasticity of the spring 13*b* (see FIG. 5). When a user performs a push action, the soft portions 22*a* provide intensive frictional force with respect to a skating surface. The wheel 30 can reach a certain rotational speed in a shorter period of time by the frictional force due to the soft portions 22*a*. With repeated push actions, a rotational speed of the wheel 30 is gradually increased. When the wheel 30 is rotated at a certain speed, the weight 13*a* is moved toward the outer rim portion 5*b* by centrifugal force of the wheel 30 (see FIG. 6). When all the weights 13*a* are positioned near to the outer rim portion 5*b* of the hub 11, the wheel 30 has a moment of inertia increased in proportion to the total weight added to the outer rim portion 5*b*. Consequently, an in-line skate with the wheel 30 mounted thereon enables a user to skate at a higher speed in a short period of time by a user's push power efficiently applied to a skating surface and the increased turning force of the wheels 30.

As described above, the present invention provides a wheel for an in-line skate which is provided with any one or both of, means for increasing turning force received in a central hub, and a soft portions provided at curved side portions, depending on its embodiment. By the means for increasing turning force and the soft portions, the wheel enables a user to achieve at a high speed in a short period of time. Consequently, an acceleration from standstill, which can be achieved on a surface, is remarkably improved.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A wheel for in-line skates, comprising:

a central hub including an inner ring portion, an outer rim portion disposed around the inner ring portion, and a connector extending between the inner ring portion and the outer rim portion;

a tire surrounding the outer rim portion of the central hub; and a bearing assembly fitted in the inner ring portion of the central hub;

wherein the central hub includes a reception cavity provided in the connector, a weight received in the reception cavity and adapted to be moved from the inner ring portion to the outer rim portion of the central hub by a centrifugal force of the wheel, and an elastic element for biasing the weight to the inner ring portion.

2. The wheel for in-line skates as set forth in claim 1, wherein the connector of the central hub comprises a plurality of spokes radially extending from the inner ring portion to the outer rim portion.

3. The wheel for in-line skates as set forth in claim 1, wherein the reception cavity of the central hub is formed such that an outer end of the reception cavity is positioned at an outer surface of the outer rim portion and opened thereat, and an inner end thereof is positioned near to the inner ring portion, and wherein the opening formed at the outer end of the reception cavity is closed by a locking plug.

4. The wheel for an in-line skate as set forth in claim 1, wherein the weight is made of metal, and the elastic element for biasing the weight is comprised of an elastic spring.

* * * * *